US006197483B1

(12) United States Patent
Marrese et al.

(10) Patent No.: US 6,197,483 B1
(45) **Date of Patent: *Mar. 6, 2001**

(54) PHOTOGRAPHIC PROCESSING USING BIODEGRADABLE BLEACHING AGENT FOLLOWED BY FIXING

(75) Inventors: Carl A. Marrese, Penfield; Alaine M. Gray, Bloomfield; David G. Foster, W. Henrietta, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/216,341

(22) Filed: Dec. 18, 1998

(51) Int. Cl.[7] ..... G03C 7/42
(52) U.S. Cl. ..... 430/393; 430/430; 430/455
(58) Field of Search ..... 430/393, 430, 430/455

(56) References Cited

U.S. PATENT DOCUMENTS

| | | | |
|---|---|---|---|
| 4,294,914 | 10/1981 | Fyson | 430/418 |
| 5,061,608 | 10/1991 | Foster et al. | 430/461 |
| 5,149,618 | 9/1992 | Tappe et al. | 430/393 |
| 5,238,791 | 8/1993 | Tappe et al. | 430/393 |
| 5,270,148 * | 12/1993 | Morigaki et al. | 430/372 |
| 5,334,491 | 8/1994 | Foster et al. | 430/393 |
| 5,434,035 | 7/1995 | Craver et al. | 430/398 |
| 5,508,150 | 4/1996 | Craver et al. | 430/393 |
| 5,585,226 | 12/1996 | Strickland et al. | 430/393 |
| 5,652,085 | 7/1997 | Wilson et al. | 430/393 |
| 5,693,456 | 12/1997 | Foster et al. | 430/461 |

FOREIGN PATENT DOCUMENTS

| | | |
|---|---|---|
| 4 226 372 A1 | 4/1994 | (DE) . |
| 0 858 001 A1 | 2/1997 | (EP) . |

* cited by examiner

*Primary Examiner*—Hoa Van Le
(74) *Attorney, Agent, or Firm*—J. Lanny Tucker

(57) ABSTRACT

Color photographic silver halide materials, especially color photographic papers, are processed effectively with reduced iron retention after bleaching with a biodegradable bleaching composition. Bleaching is accomplished using an iron chelate of a biodegradable chelating ligand in the presence of a polyphosphonic acid. This bleaching step is followed by fixing using a fixing composition that includes a fixing agent and a polycarboxylic acid.

16 Claims, 2 Drawing Sheets

PHOTOGRAPHIC PROCESSING USING BIODEGRADABLE BLEACHING AGENT FOLLOWED BY FIXING

FIELD OF THE INVENTION

The present invention relates to photochemical processing of silver halide photographic materials. In particular, it relates to a method of photographic processing whereby bleaching is accomplished using a biodegradable bleaching agent, followed by a fixing step.

BACKGROUND OF THE INVENTION

The basic image-forming process of color photography comprises the exposure of a silver halide photographic recording material, such as a color film, to light, and the chemical processing of the exposed material to provide a useful image. The chemical processing involves two fundamental steps. The first is a treatment of the exposed silver halide material with a color developing agent wherein some or all of the silver ion is reduced to metallic silver and a dye image is formed.

The second fundamental step is the removal of silver metal by one or more steps of bleaching and fixing so that only a dye image remains in the processed material. During bleaching, the developed silver is oxidized to a silver salt by a suitable bleaching agent. The oxidized silver is then dissolved and removed from the element using a "fixing" agent or silver solvent in a fixing step.

The most common bleaching agents are complexes of ferric ion and various organic ligands (such as aminopolycarboxylic acids), of which there are hundreds of possibilities, all with varying bleaching activities and biodegradability. Common organic ligands used as part of bleaching agents for color film processing include ethylenediaminetetraacetic acid (EDTA), propylenediaminetetraacetic acid (PDTA), methyliminodiacetic acid (MIDA) and nitrilotriacetic acid (NTA).

U.S. Pat No. 4,294,914 (Fyson) describes bleaching and bleach-fixing compositions and a processing method using a ferric complex of one of several alkyliminodiacetic acids, which are known to be more biodegradable than other common organic ligands such as EDTA. Other bleaching agents using similar organic ligands are described in U.S. Pat. No. 5,061,608 (Foster et al) in which the bleaching agent is advantageously combined with specific aliphatic carboxylic acids to reduce dye stains. U.S. Pat. No. 5,334,491 (Foster et al) also describes the use of similar biodegradable bleaching agents in combination with specific levels of bromide ion.

U.S. Pat. No. 5,508,150 (Craver et al) describes another solution to the problem of iron stain. Bleaching is carried out using a bleaching agent that is ferric ion chelated with a tridentate or tetradentate ligand. MIDA is an example of a tridentate ligand. Bleaching is followed by fixing with a composition comprising an uncomplexed polycarboxylate.

In processes utilizing methyliminodiacetic acid (MIDA) as the bleaching agent ligand, iron-MIDA dissociation may occur in the wash bath. This rust formation must be controlled by preventing the dissociation of MIDA from ferric ion. In copending and commonly assigned U.S. Ser. No. 08/795,885, filed Feb. 6, 1997, by Foster, a method of photographic processing is described wherein "anti-rust" agents are included in the bleaching solutions in order to control the dissociation of MIDA and similar ligands from ferric ion. Such agents are defined as organic phosphonic or phosphinic acids or salts thereof and were found to be highly effective.

However, during an investigation of various biodegradable bleaching compositions including those containing MIDA, a severe yellow stain from retained iron was observed in some processed photographic elements. Various additives have been tested to eliminate such stains.

For example, DE 4,226,372 (Tappe et al) describes bleaching solutions containing excess β-alaninediacetic acid (ADA) and a hydroxycarboxylic acid additive, such as citric acid or tartaric acid, to reduce the precipitation of iron hydroxide in the wash bath following bleaching. However, such additives are not effective with the use of every biodegradable bleaching agent including the use of MIDA.

Thus, there is continuing need for a means to reduce or eliminate iron stain in all processed photographic elements, especially those processed using biodegradable bleaching agents.

SUMMARY OF THE INVENTION

The problems noted above have been overcome with a method of processing a photographic silver halide material, comprising the steps of:

A) bleaching an imagewise exposed and color developed photographic silver halide material using a bleaching composition comprising:
   as a bleaching agent, an iron chelate of a biodegradable aminopolycarboxylic acid chelating ligand, and at least 0.008 mol/l of a polyphosphonic or polyphosphinic acid, or a salt thereof, in uncomplexed form, and B) fixing the bleached film with a fixing composition comprising a fixing agent and at least 0.01 mol/l of a polycarboxylic acid, or a salt thereof.

Yellow stain from retained iron is reduced in processed photographic materials using the present invention when a combination of a specific bleaching composition and a specific fixing composition is used. The bleaching composition includes a ferric ion biodegradable bleaching agent and a polyphosphonic or polyphosphinic acid additive that appears to reduce the iron stain considerably. Fixing is then carried out with a composition containing a polycarboxylic acid as well as a fixing agent. It was not expected to us that the use of the two photographic processing compositions described above, in combination, would improve Dmin in all color records (particularly in the blue-sensitive color record), as was achieved in the practice of the present invention. This unexpected result was particularly noticeable for processing color photographic papers.

DETAILED DESCRIPTION OF THE INVENTION

Figure 1:
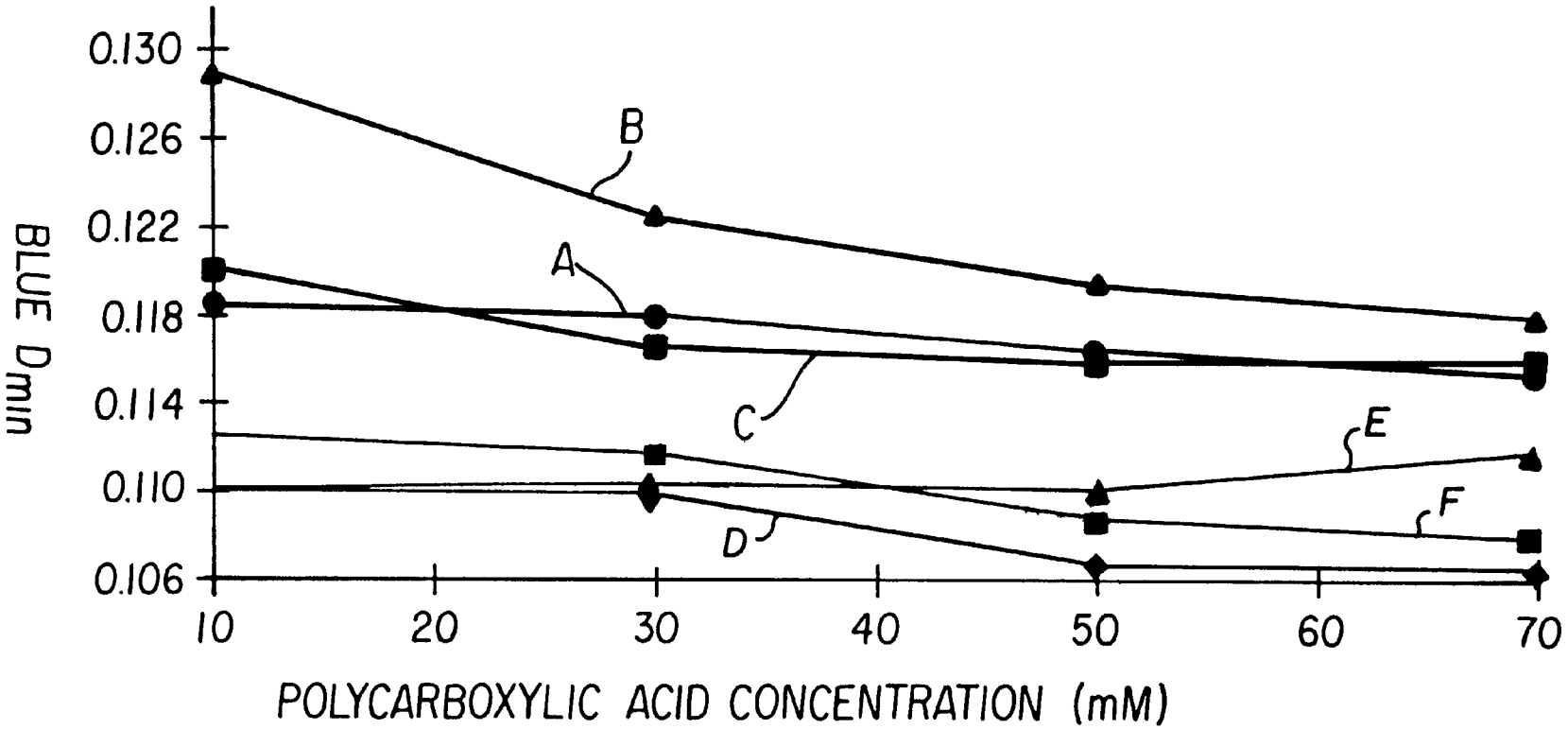
FIG. 1 is a graphical representation of blue minimum density ($D_{min}$) after bleaching and fixing using certain additives in the fixing composition, for the Control and invention methods described in Example 1 below.

The method of this invention includes a bleaching step using one or more bleaching agents that are ferric complexes of one or more biodegradable aminopolycarboxylic acid chelating ligands (described below). Thus, the bleaching agents are binary complexes, meaning each ferric ion is complexed with one or more molecules of the same chelating ligand, as opposed to ternary complexes in which the ferric ion is complexed with two molecules of two distinct chelating ligands, such as those described for example in U.S. Pat. No. 5,670,305 (Gordon et al). In addition, multiple binary iron complexes can be present in the bleaching composition providing multiple ferric binary bleaching agents.

A preferred class of useful biodegradable complexing ligands are iminodiacetic acid and its derivatives (or salts thereof). Preferred compounds are alkyliminodiacetic acids that have a substituted or unsubstituted alkyl group having 1 to 6 carbon atoms (such as methyl, ethyl, n-propyl, isopropyl and t-butyl). Particularly useful alkyliminodiacetic acids are methyliminodiacetic acid (MIDA, Compound I-2) and ethyliminodiacetic acid (EIDA, Compound I-3). These ligands can be used in the free acid form or as a lithium, sodium, potassium or ammonium salt. These and other ligands of this class can be represented by structure I:

I

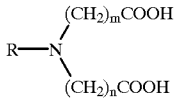

wherein m and n are independently 1, 2 or 3, and preferably each is 1. R is hydrogen, a substituted or unsubstituted alkyl group (having 1 to 10 carbon atoms), a substituted or unsubstituted aryl groups (having 6 to 10 carbon atoms in the aromatic ring), or a substituted or unsubstituted heterocyclic group having from 5 to 10 carbon and heteroatoms (nitrogen, sulfur or oxygen). Preferably, R is hydrogen or a substituted or unsubstituted alkyl group having 1 to 3 carbon atoms, and more preferably, it is hydrogen, methyl or ethyl. Substituents that can be present in the alkyl, aryl and heterocyclic group include any monovalent moiety that does not bind to ferric ion, such as alkoxy (having 1 to 6 carbon atoms), amino, carboxy, phosphono, sulfo, —$SR_1$, —$CONR_2R_3$, and others readily apparent to one skilled in the art, wherein $R_1$ through $R_3$ independently represent hydrogen or a substituted or unsubstituted alkyl group as described above for R.

Useful compounds within the scope of structure I include (and their salts):

I-1

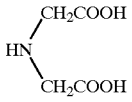

I-2

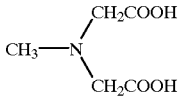

I-3

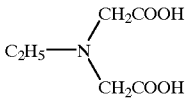

I-4

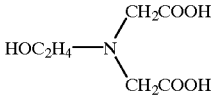

-continued

I-5

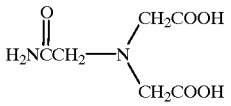

I-6

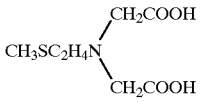

I-7

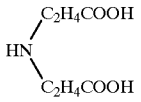

I-8

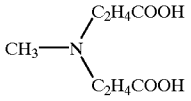

I-9

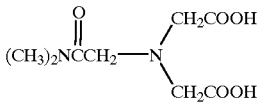

Another class of biodegradable aminopolycarboxylic acid chelating ligands useful to form bleaching agents can be represented by structure II (including their alkali metal and ammonium salts):

II

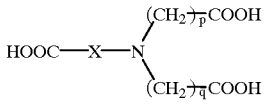

wherein p and q are independently 1, 2 and 3, and preferably each is 1. The linking group X may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group. If substituted, such substituents can be those defined above for the ligands of structure I. Preferably, X is a substituted or unsubstituted alkylene group of 1 to 3 carbon atoms.

Representative compounds within the scope of structure II include (and their salts):

II-1

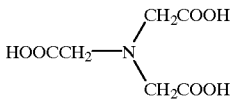

II-2

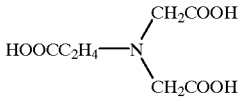

-continued

II-3

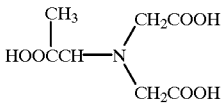

II-4

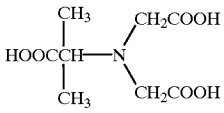

II-5

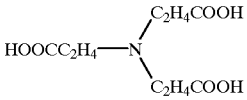

II-6

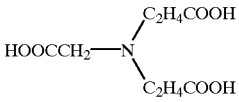

Still another useful class of biodegradable chelating ligands are polyaminodisuccinic and polyaminomonosuccinic acids (or salts thereof). Polyaminodisuccinic acids are compounds having two or more nitrogen atoms, and two of the nitrogen atoms are bonded to succinic acid groups (or salts thereof). Preferably, only two nitrogen atoms each have one succinic acid (or salt) group attached thereto. The compounds have at least two nitrogen atoms, preferably no more than ten nitrogen atoms, and more preferably, no more than 6 nitrogen atoms. The remaining nitrogen atoms (not attached to a succinic acid group) are preferably substituted with hydrogen atoms only, but other substituents can also be present. Most preferably, the succinic acid group(s) are attached to terminal nitrogen atoms, meaning (first or last nitrogen in the compounds). More details about such compounds, along with representative polyaminodisuccinic acid and polyaminomonosuccinate acid chelating ligands are provided in EP-A-0 532,003, U.S. Pat. No. 5,652,085 (Wilson et al), and U.S. Pat. No. 5,585,226 (Strickland et al), all incorporated herein by reference. Ethylenediamine-N,N'-disuccinic acid (EDDS) and its salts are most preferred in this class of compounds. All isomers are useful, including the [S,S] isomer used alone, and can be used singly or in mixtures.

Polyaminomonosuccinic acids (or salts thereof) are compounds having at least two nitrogen atoms to which a succinic acid (or salt) group is attached to one of the nitrogen atoms. Otherwise, the compounds are defined similarly to the polyaminodisuccinic acids described above. U.S. Pat. No. 5,652,085 (Wilson et al) also provides more details about such compounds. Ethylenediaminemonosuccinic acid (EDMS) and its salts are preferred. Mixtures of bleaching agents that are ferric ion complexes of EDDS and EDMS are also useful.

Biodegradability is measured by the OECD 301B "Ready Biodegradability: Modified Sturm Test" which is well known in the photographic processing art.

Also within the bleaching composition is one or more polyphosphonic or phosphinic acids that can be represented by the following structures III and IV:

These anti-rust agents are organic phosphonic or phosphinic acids or salts thereof, represented by the following structures III:

$$R_4N(CH_2PO_tM_2)_2$$

or (IV):

$$R_5R_6C(PO_tM_2)_2$$

wherein t is 2 or 3, and preferably 3, $R_4$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, β-phenethyl, or o-octamidobenzyl), a substituted or unsubstituted alkylaminoalkyl group (wherein the alkyl portion of the group is an defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylene-methoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, primidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R_5$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_tM_2$ or $—CHR_7PO_tM_2$.

$R_6$ is hydrogen, hydroxyl, a substituted or unsubstituted alkyl group of 1 to 12 carbon atoms (defined above) or $—PO_tM_2$.

$R_7$ is hydrogen, hydroxyl, a substituted or unsubstituted alkyl group of 1 to 12 carbon atoms (as defined above) or $—PO_tM_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo), sulfono or sulfoxo, alkoxy of 1 to 5 carbon atoms (linear or branched), $—PO_tM_2$, $—CH_2PO_tM_2$ or $—N(CH_2PO_tM_2)_2$ wherein the alkyl (linear or branched) for any of these groups has 1 to 5 carbon atoms.

Representative phosphonic acids useful in the practice of this invention include, but are not limited to, aminotrismethylenephosphonic acid, aminodimethylenephosphonic acids, aminodisphosphonic acids, N-acylaminodisphosphonic acids, and the compounds listed in EP 0 428 101A1 (page 4) and U.S. Pat. No. 4,892,804 (Vincent et al). Representative useful compounds are 1-hydroxyethylidene-1,1-diphosphonic acid, diethylenetriaminepentaphosphonic acid, ethylenediamine-N,N,N',N'-tetramethylenephosphonic acid, nitrilo-N,N,N-trimethylenephosphonic acid (or aminotrismethylenephosphonic acid), 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane-1,1-diphosphonic acid, diethylenetriamine-N,N,N',N",N"-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, or salts thereof.

Particularly useful are nitrilo-N,N,N-trimethylenephosphonic acid (or aminotrismethylenephosphonic acid) or salts thereof.

The polyphosphonic or polyphosphinic acid is present in the bleaching composition useful in the practice of this invention at a concentration of at least 0.008 and preferably at least 0.01 mol/l, and generally up to 0.1 and preferably up to 0.08 mol/l. An optimum concentration can be readily determined for a given polyphosphonic or polyphosphinic acid using routine experimentation.

In preferred embodiments, a rehalogenating agent, such as chloride or bromide ions, is present in the bleaching composition. The rehalogenating agent can be present in any effective concentration, with useful concentrations typically being at least about 0.1 mol/l, and preferably at least about 0.2 mol/l. Bromide ions are preferred when the emulsions being processed are predominantly silver bromide (such as in photographic color negative or color reversal films). Chloride ions are preferred when the emulsions are predominantly silver chloride (such as in photographic color papers). Chloride or bromide ions can be used in the form of potassium, sodium or ammonium salts.

The bleaching composition used in this invention is not a bleach-fixing solution and thus does not contain photographically useful concentrations of silver ion solvents (or fixing agents). Fixing is accomplished using a separate fixing composition as described below.

The bleaching composition can also include other addenda that may be useful in bleaching solutions, such as buffers, anti-scumming agents, antioxidants and anti-foam agents.

Useful buffers include acetic acid, propionic acid, succinic acid, tartaric acid, and other water-soluble aliphatic carboxylic acids known in the art. Acetic acid is preferred. Other buffers, such as borates and carbonates can be used if desired. The bleaching solutions are aqueous acidic solutions preferably having a pH of from about 2 to about 5, but a different pH can be used if desired. A preferred pH is in the range of from about 2.5 to about 4.5.

It is not necessary that the ferric ion and the biodegradable complexing ligand be present in the bleaching composition in stoichiometric proportions. It is preferred that the molar ratio of the ligand to ferric iron be from about 1:1 to about 5:1. In a more preferred embodiment, the ratio is from about 2 to about 3 moles of each complexing ligand per mole of ferric ion.

Generally speaking, the iron is present in the bleaching composition in an amount of at least 0.001 mol/l, and preferably at least 0.5, and generally up to 1 mol/l, and preferably up to 0.6 mol/l. Lower levels of about 2 g/l are commonly used to bleach color paper. Levels of from about 10 to about 25 g/l are commonly used when rapid bleaching action is desired.

The fixing composition used before or after bleaching in the practice of this invention is an aqueous composition containing one or more useful fixing agents, with or without fixing accelerators. Useful fixing agents include, but are not limited to, sulfites, thiocyanates, thiosulfates, and mixtures thereof. Fixing accelerators include, but are not limited to, thioethers, and mercaptotriazoles. Fixing agents are generally present in an amount of at least 0.2 mol/l, preferably at least 0.4 mol/l, and generally up to 1 mol/l, and preferably up to 0.8 mol/l.

It is essential that the fixing composition also include one or more polycarboxylic acids (or salts) in uncomplexed form. Thus, such compounds are present in "free" form in the composition. Useful polycarboxylic acids can include those biodegradable compounds that are used in complexed form in the bleaching composition, as well as many others that would be readily apparent to one skilled in the art, including those described in U.S. Pat. No. 5,541,041 (Haye), U.S. Pat. No. 5,434,035 (noted above), U.S. Pat. No. 5,582,958 (Buchanan et al), U.S. Pat. No. 5,585,226 (Strickland et al) and U.S. Pat. No. 5,652,085 (Wilson et al), all incorporated herein by reference.

Thus, the polycarboxylic acids can include simple di- or tricarboxylic acids (or salts thereof), aminopolycarboxylic acids (or salts thereof) or polyaminopolycarboxylic acids (or salts thereof). Some useful classes of such materials include, but are not limited to, polyaminodisuccinic acids, polyaminomonosuccinic acids, and the compounds having the following structures V–XI:

(V)

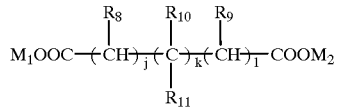

wherein $R_8$ and $R_9$ are independently hydrogen or hydroxy, $R_{10}$ and $R_{11}$ are independently hydrogen, hydroxy or carboxy (or a corresponding salt), $M_1$ and $M_2$ are independently hydrogen or a monovalent cation (such as ammonium, sodium, potassium or lithium), j, k and 1 are 0 or 1, provided that at least one of j, k and 1 is 1, (VI)

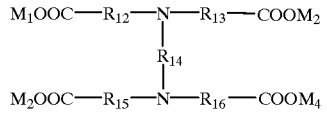

wherein $R_{12}$–$R_{16}$ are independently a linear or branched substituted or unsubstituted alkylene group of 1 to 8 carbon atoms (such as methylene, ethylene, trimethylene, hexamethylene, 2-methyltrimethylene and 4-ethylhexamethylene), and $M_1$, $M_2$, $M_3$ and $M_4$ are independently hydrogen or a monovalent cation, as defined above for $M_1$ and $M_2$, (VII)

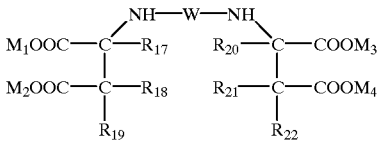

wherein $R_{17}$–$R_{22}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), $M_1$, $M_2$, $M_3$ and $M_4$ are as defined above, and W is a covalent bond or a divalent substituted or unsubstituted aliphatic linking group (defined below), (VIII)

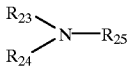

wherein at least two of $R_{23}$, $R_{24}$ and $R_{25}$ are a carboxymethyl (or equivalent salts), and the third group is hydrogen, a substituted or unsubstituted alkyl group of 1 to 5 carbon atoms (as defined above), a substituted or unsubstituted hydroxyethyl or unsubstituted carboxymethyl (or equivalent salts), (IX)

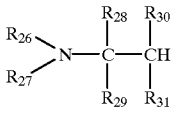

wherein $R_{26}$ and $R_{27}$ are independently substituted or unsubstituted carboxymethyl (or equivalent salts) or 2-carboxyethyl (or equivalent salts), and $R_{28}$–$R_3$ are independently hydrogen, a substituted or unsubstituted alkyl group of 1 to 5 carbon atoms (as defined above), hydroxy, carboxy, carboxymethylamino, or substituted or unsubstituted carboxymethyl (or equivalent salts), provided that only one of $R_{28}$–$R_{31}$ is carboxy, carboxymethylamino, or substituted or unsubstituted carboxymethyl (or equivalent salts), (X)

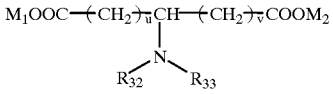

wherein $R_{32}$ and $R_{33}$ are independently hydrogen, a substituted or unsubstituted alkyl group of 1 to 5 carbon atoms (as defined above), substituted or unsubstituted hydroxyethyl, substituted or unsubstituted carboxymethyl or 2-carboxyethyl (or equivalent salts), $M_1$ and $M_2$ are as defined above, and u and v are independently 0, 1 or 2 provided that the sum of u and v does not exceed 2, or (XI)

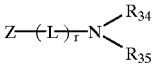

wherein

Z represents a substituted or unsubstituted aryl group of 6 to 10 carbon atoms in the nucleus (as defined above) or a substituted or unsubstituted heterocycle having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl), L is a divalent substituted or unsubstituted aliphatic linking group (defined below), $R_{34}$ and $R_{35}$ are independently hydrogen, a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups which form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others which would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, carboxy, sulfo, sulfonato, thioalkyl, alkylcarbonamido, alkylcarbamoyl, alkylsulfonamido, alkylsulfamoyl, carbonamido, sulfonamido, sulfamoyl, amino, halo (such as chloro or bromo), sulfono (—$SO_2$R) or sulfoxo [—S(O)R'] wherein R' is a branched or linear alkyl group of 1 to 5 carbon atoms.

Particularly useful uncomplexed polycarboxylic acids in the fixing composition include citric acid, ethylenediaminedisuccinic acid (EDDS), ethylenediaminetetraacetic acid (EDTA) and diethylenetriamine pentaacetic acid (DPTA), or salts of any of these, or mixtures of any of these.

The concentration of polycarboxylic acid is generally at least 0.01 mol/l and preferably at least 0.05 mol/l, and generally up to 0.1 mol/l and preferably up to 0.07 mol/l. An optimum amount for a given polycarboxylic acid can be readily determined using routine experimentation.

The fixing composition can include other addenda commonly useful in such solutions for various purposes, including buffers, and electron transfer agents.

A washing solution can be used between the bleaching and fixing steps, after the fixing step, or both. For example, a washing solution that is used between bleaching and fixing can be used by immersing the processed element in a washing bath, or sprayed onto the processed element as described, for example, in U.S. Ser. No. 09/085,428, filed May 27, 1998 by Feeney et al. This washing solution can be merely water, or a solution comprising one or more surfactants that are commonly used in photographic rinsing solutions, as described for example, in U.S. Pat. No. 3,369,896 (Seeman et al), U.S. Pat. No. 3,545,970 (Gingianni et al) and U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al). Particularly useful rinsing solutions include a mixture of surfactants, such as one or more nonionic surfactants with one or more anionic surfactants.

Additionally, the washing solutions can be what are known as "stabilizing" solutions including one or more surfactants, and one or more compounds that stabilize dyes formed in color photographic materials during processing. Stabilizing compounds can include, but are not limited to, formaldehyde or formaldehyde precursors such as sodium formaldehyde bisulfite, methylol compounds, as described for example in U.S. Pat. No. 4,927,746 (Schwartz), U.S. Pat. No. 5,529,890 (McGuckin et al), U.S. Pat. No. 5,578,432 (McGuckin et al), U.S. Pat. No. 5,415,979 (Takemura et al) and U.S. Pat. No. 5,716,765 (McGuckin et al), as well as various aldehydes as described for example in U.S. Pat. No. 5,362,609 (Kuwae et al), U.S. Pat. No. 5,424,177 (Kobayashi et al), and U.S. Pat. No. 5,441,852 (Hagiwara et al).

The bleaching and fixing compositions can be used to process the photographic materials described herein using conventional processing equipment and conditions. Generally, the processing equipment includes a series of tanks containing the various processing compositions in sequence. In most of such processing apparatus, the processed materials are generally immersed in the processing solutions. The volumes of the processing compositions can vary from less than 100 ml to 50 liters. Such processing equipment may also include rollers to guide the photographic material through the various processing tanks.

Processing according to the present invention can be carried out using conventional tanks holding processing solutions. Alternatively, it can be carried out using what is known in the art as "low volume thin tank" processing systems using either rack and tank or automatic tray designs. Such processing methods and equipment are described, for example, in U.S. Pat. No. 5,436,118 (Carli et al) and publications cited therein.

The present invention is useful in the processing of color photographic elements, including photographic color negative films and photographic color papers. Useful color negative film processes include the steps of color development, bleaching, fixing and stabilizing or washing. This invention is particularly useful for processing photographic color papers.

Bleaching according to this invention can be carried out in less than 6 minutes, but even shorter times are possible under certain conditions. For color papers, the time may be for up to 2 minutes, and more preferably up to 90 seconds. Bleaching temperatures are generally from about 20 to about 40° C. Fixing can be carried out for similar times and temperatures, and preferably for up to 45 seconds. For what is considered "rapid" processing, bleaching may be carried out for up to 60 seconds, and fixing for up to 40 seconds.

The bleaching and fixing compositions described above can be used as working tank solutions or replenishers, and can be in diluted or concentrated form for a regenerator and/or replenisher. Both compositions can be replenished at a replenishment rate of less than about 1000 ml/m$^2$. Replenishment can be accomplished directly into the processing tank, or a portion of overflow can be mixed with a regenerator to provide a suitable regenerated replenisher. The regenerator concentrate itself can be delivered directly to the processing tank.

The details of such processes including color developing solutions, fixing solutions, stabilizing solutions, conditioning solutions, first developer solutions (for reversal processes), and the color photographic elements processed therein, including emulsions, supports and other details thereof, are well known from hundreds of publications, some of which are listed in *Research Disclosure*, publication 38957, pages 592–639, September 1996, incorporated herein by reference. *Research Disclosure* is a publication of Kenneth Mason Publications Ltd., Dudley House, 12 North Street, Emsworth, Hampshire PO10 7DQ England.

The following examples are provided to illustrate the present invention, but the invention is not to be interpreted as so limited. Unless otherwise indicated, percentages are by weight.

EXAMPLE 1

A biodegradable bleaching composition useful in the present invention (Invention) was formulated with the following components and amounts:

| | |
|---|---|
| Potassium methyliminodiacetate | 35.1 g |
| Potassium bromide | 15 g |
| Ferric nitrate (30% solution) | 37.2 g |
| Glacial acetic acid | 26.2 g |
| DEQUEST ™ 2000 sequestering agent | 4.5 g |
| Water | up to 1 liter |
| pH | adjusted to 4.0 |

The molar ratio of MIDA to ferric ion in this solution is 2.6:1, and ferric ion was present at 3.35 g/l. DEQUEST™ 2000 is a polyphosphonic acid within the scope of the present invention (it is aminotrismethylene-phosphonic acid). A Control bleaching composition was similarly prepared by leaving out the polyphosphonic acid.

The fixing compositions used with the bleaching composition had the following basic composition:

| | |
|---|---|
| Sodium thiosulfate (anhydrous) | 29.6 g |
| Potassium sulfite (45% solution) | 56.4 g |
| Potassium carbonate (47% solution) | 7.72 g |
| Various polycarboxylic acids | See TABLE I below |

-continued

| | |
|---|---|
| Water<br>pH adjusted to 7.0 | up to 1 liter |

TABLE I

| POLYCARBOXYLIC ACID (OR SALT) | 0.010 mol/l (grams added) | 0.030 mol/l (grams added) | 0.050 mol/l (grams added) | 0.070 mol/l (grams added) |
|---|---|---|---|---|
| Citrate | 1.921 | 5.763 | 9.605 | 13.44 |
| Ethylenediaminetetraacetic acid | 2.922 | 8.766 | 14.61 | 20.45 |
| Ethylenediaminedisuccinic acid | 2.922 | 8.768 | 14.61 | 20.45 |

Simulated wash solutions in various tanks were formulated by adding the appropriate amount of silver to wash water. The following processing protocol was used in the method of this invention. Color development was carried out using commercially available KODAK EKTACOLOR RA Developer and Replenisher. The "acid stop" solution contained either acetic or sulfuric acid.

| | | |
|---|---|---|
| Color development | 38° C. | 45 seconds |
| Acid stop | 35° C. | 25 seconds |
| Washing | 32° C. | 25 seconds |
| Bleaching | 35° C. | 90 seconds |
| Washing | 32° C. | 45 seconds |
| Fixing | 35° C. | 45 seconds |
| Washing | 32° C. | 25 seconds |
| Washing | 32° C. | 25 seconds |
| Washing | 32° C. | 25 seconds |
| Washing | 32° C. | 25 seconds |
| Drying | | |

Samples of commercially available KODAK EKTACOLOR EDGE 5 Color Paper were imagewise exposed and processed using compositions and conditions described above using either the Invention or Control bleaching compositions. Following drying, the processed samples were evaluated for stain.

FIG. 1 shows the results of using the Control and Invention bleaching compositions. Curves A (Control) and D (Invention) show the results of stain when citrate was present in the fixing composition. Curves B (Control) and E (Invention) show the results of stain when ethylenediaminetetraacetic acid was present in the fixing composition, and Curves C (Control) and F (Invention) show the results of stain when ethylenediaminedisuccinic acid was present in the fixing composition.

As can be seen from comparing the curves for the Control method and the Invention method in FIG. 1, the level of stain ($D_{min}$ in the blue-light sensitive layer) was reduced by the addition the various polycarboxylic acids listed in TABLE I to the fixing composition. Thus, it was surprising to us that when the fixing composition containing the polycarboxylic acid was used in combination with the bleaching composition containing the polyphosphonic acid, stain (blue $D_{min}$) could be reduced in the processed color papers.

Figure 2:
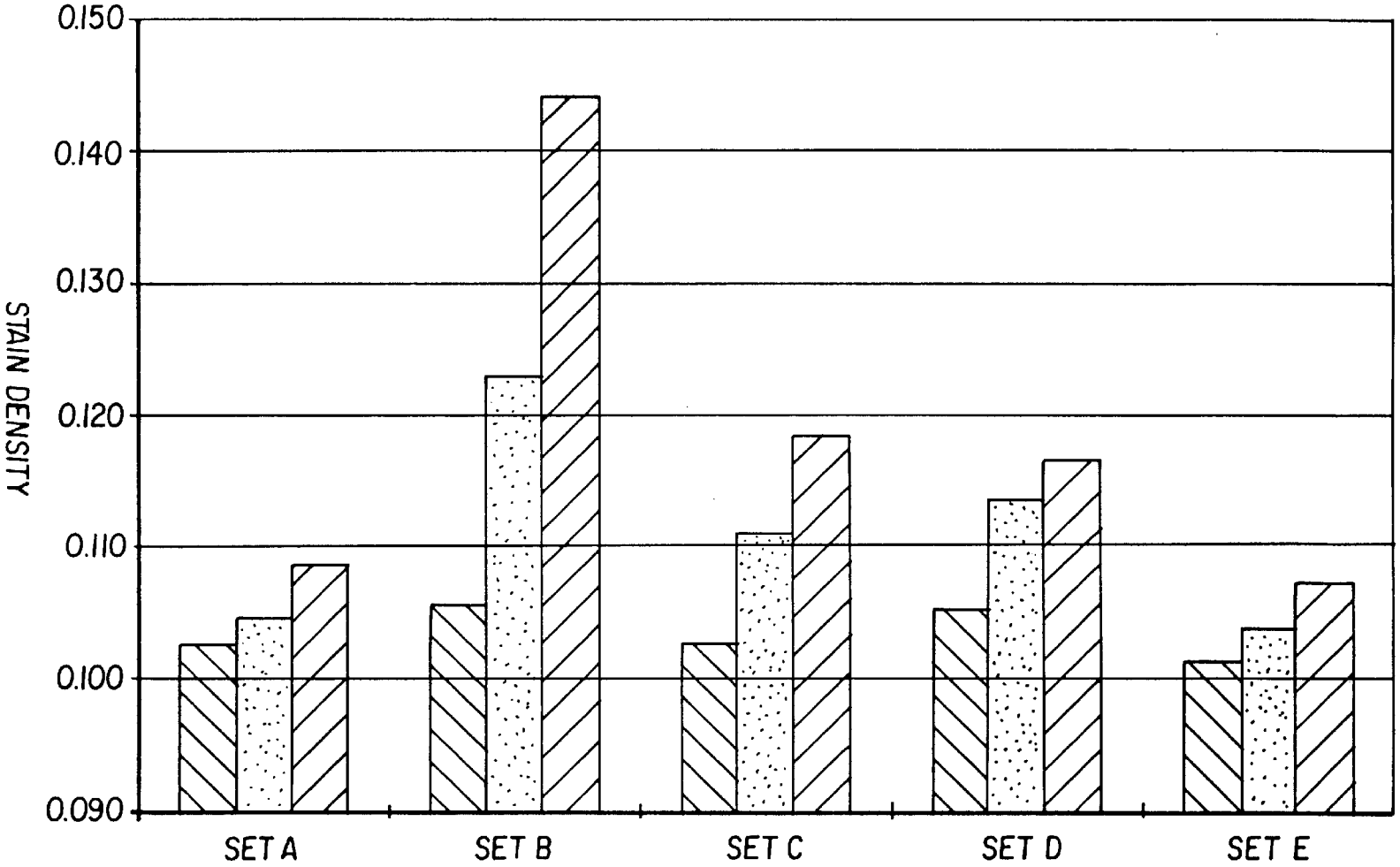
FIG. 2 is a bar graph showing the resulting stain density using various combinations of bleaching and fixing compositions as described in Example 1 below.

Referring to FIG. 2, stain density is shown in bar graph form for all three color records (red-, green- and blue-sensitive color records from left to right in each set of bars) several bleaching/fixing combinations. The sets of bars are identified as follows:

Set A: Standard KODAK EKTACOLOR RA Bleaching and Fixing compositions,

Set B: Standard KODAK EKTACOLOR RA Bleaching composition and Fe-MIDA bleaching composition (no polyphosphonic acid), Set C: Standard KODAK EKTACOLOR RA Bleaching composition and Fe-MIDA bleaching composition with polyphosphonic acid, Set D: Fe-MIDA bleaching composition (without polyphosphonic acid) and fixing composition containing citrate, and Set E: Invention: Fe-MIDA bleaching composition with polyphosphonic acid and fixing composition with citrate.

Viewing the data in FIG. 2 from left to right, it can be seen that without citric acid in the fixing composition and without the polyphosphonic acid in the bleaching composition (Sets B–D), the stain in all three color record of the processed color papers is higher than that observed when the color papers were processed using conventional Process RA-4 and conventional bleaching and fixing compositions for that process (Set A). The addition of the polyphosphonic acid to the bleaching composition clearly reduced the stain (Set C), but the stain was still too high. Similarly, merely adding citric acid to the fixing composition (Set D) reduced the stain, but not enough. However, when the polyphosphonic acid was used in the bleaching composition and the polycarboxylic acid (citric acid) was used in the fixing composition (Set E), the stain was reduced substantially. This was not an expected result from use of the noted compositions.

The invention has been described in detail with particular reference to preferred embodiments thereof, but it will be understood that variations and modifications can be effected within the spirit and scope of the invention.

I claim:

1. A method of processing a photographic silver halide material, comprising the steps of:

A) bleaching an imagewise exposed and color developed photographic silver halide element using a bleaching composition comprising:

as a bleaching agent, an iron chelate of a biodegradable aminopolycarboxylic acid chelating ligand, and at least 0.008 mol/l of a polyphosphonic or polyphosphinic acid, or a salt thereof, in uncomplexed form, and B) fixing the bleached element with a fixing composition comprising a fixing agent and from about 0.05 to about 0.1 mol/l of a polycarboxylic acid, or a salt thereof, the polycarboxylic acid being citric acid, ethylenediaminedisuccinic acid, or a mixture of these, in uncomplexed form, wherein yellow stain from retained iron is reduced, step A being carried out for up to two minutes and step B being carried out for up to 45 seconds.

2. The method of claim 1 wherein said photographic silver halide material is a photographic color paper.

3. The method of claim 1 further comprising a washing step between said bleaching and fixing steps.

4. The method of claim 1 wherein said bleaching agent is an iron chelate of iminodiacetic acid or a derivative thereof represented by structure I:

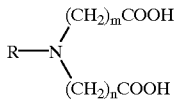

wherein m and n are independently 1, 2 or 3, R is hydrogen, an alkyl group, an aryl group or a heterocyclic group, or a salt thereof.

5. The method of claim 4 wherein said iminodiacetic acid or a salt thereof is an alkyl derivative thereof having an alkyl group of 1 to 6 carbon atoms.

6. The method of claim 4 wherein said iminodiacetic acid is one of the following compounds or a salt thereof:

I-1

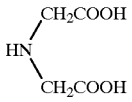

I-2

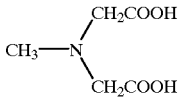

I-3

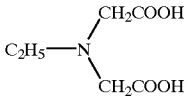

I-4

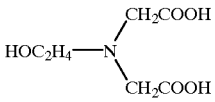

I-5

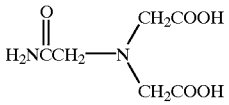

I-6

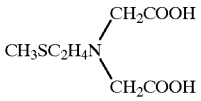

I-7

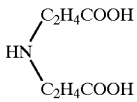

I-8

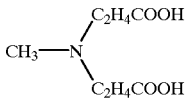

I-9

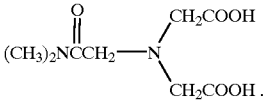

7. The method of claim 4 wherein said bleaching agent comprises an iron chelate of either iminodiacetic acid or methyliminodiacetic acid, or a salt thereof.

8. The method of claim 1 wherein said polyphosphonic or polyphosphinic acid or a salt thereof is represented by one of the structures I or II below:

wherein structures (I) and (II) are:

$$R_4N(CH_2PO_tM_2)_2 \text{ and} \quad (I)$$

$$R_5R_6C(PO_tM_2)_2 \quad (II)$$

wherein t is 2 or 3, $R_4$ is hydrogen, an alkyl group, an alkylaminoalkyl group, an alkoxyalkyl group, a cycloalkyl group, an aryl group, or a 5- to 10-membered heterocyclic group having one or more nitrogen, oxygen or sulfur atoms in the heteroring, $R_5$ is hydrogen, an alkyl group, an aryl group, a cycloalkyl group, a 5- to 10-membered heterocyclic group having one or more nitrogen, oxygen or sulfur atoms in the ring, —$PO_tM_2$ or —$CH_2R_7PO_tM_2$, $R_6$ and $R_7$ are independently hydrogen, hydroxy, an alkyl group or —$PO_tM_2$, and M is hydrogen or a water-soluble monovalent cation.

9. The method of claim 8 wherein said polyphosphonic acid is an aminotrismethylenephosphonic acid, aminodimethylenephosphonic acid, aminodisphosphonic acid, or N-acylaminodisphosphonic acid, or a salt thereof.

10. The method of claim 1 wherein said polyphosphonic acid is aminotrismethylene phosphonic acid, or a salt thereof.

11. The method of claim 1 wherein said polyphosphonic or polyphosphinic acid or salt thereof is present in said bleaching composition at a concentration of from about 0.01 to about 0.1 mol/l.

12. The method of claim 1 wherein said fixing agent is a thiosulfate, thiocyanate, or a mixture of a thiosulfate and thiocyanate.

13. The method of claim 1 wherein the amount of iron in said bleaching agent in said bleaching solution is at least 0.001 mol/l, and the molar ratio of chelating ligand to iron is at least 1:1.

14. The method of claim 1 wherein step A is carried out for up to 90 seconds.

15. The method of claim 1 wherein step A is carried out for up to 60 seconds, and step B is carried out for up to 40 seconds, wherein said photographic silver halide material is a color photographic paper.

16. A method of processing a photographic silver halide material in a processor, comprising the steps of:

A) bleaching an imagewise exposed and color developed photographic silver halide element using a bleaching composition comprising:

as a bleaching agent, an iron chelate of methyliminodiacetic acid, or a salt thereof, wherein the concentration of iron is at least 0.001 mol, and at least 0.01 mol/l of aminotrismethylene phosphonic acid in uncomplexed form, and B) fixing the bleached element with a fixing composition comprising at least 0.2 mol/l of a thiosulfate fixing agent and from about 0.05 to about 0.1 mol/l of citric acid or a salt thereof, inuncomplexed form, wherein yellow stain from retained iron is reduced, step A being carried out for up to two minutes and step B being carried out for up to 45 seconds.

* * * * *